US005181192A

United States Patent [19]

Paratte et al.

[11] Patent Number: 5,181,192

[45] Date of Patent: Jan. 19, 1993

[54] HOUSING FOR AN ENERGY CELL IN A WRISTWATCH

[75] Inventors: Daniel Paratte, Neuchâtel; Jean-Pascal Aeschbacher, Moûtier, both of Switzerland

[73] Assignee: ETA SA Fabriques d'Ebauches, Granges, Switzerland

[21] Appl. No.: 710,793

[22] Filed: Jun. 5, 1991

[30] Foreign Application Priority Data

Jun. 7, 1990 [CH] Switzerland ..... 01910/90

[51] Int. Cl.[5] ..... G04B 37/00

[52] U.S. Cl. ..... 368/282; 368/204; 368/281

[58] Field of Search ..... 368/203, 204, 281, 282, 368/309

[56] References Cited

U.S. PATENT DOCUMENTS 4,629,329 12/1986 Komiyami ..... 368/204
4,842,966 6/1989 Omori et al. ..... 368/204
4,884,252 11/1989 Teodoridis et al. ..... 368/10
4,926,401 5/1990 Vuilleumier et al. ..... 368/88

FOREIGN PATENT DOCUMENTS 1803093 3/1959 Fed. Rep. of Germany .
2299670 8/1976 France .
2389167 11/1978 France .
32766 3/1978 Japan ..... 368/203

*Primary Examiner*—Bernard Roskoski
*Attorney, Agent, or Firm*—Griffin, Butler, Whisenhunt & Kurtossy

[57] ABSTRACT

This wristwatch includes a watch case (1), time displaying means (3, 4) and an energization cell (5). The cell can be fitted into a lateral opening (10) giving access to a housing formed in the watch case. The cell is carried by a drawer (6) which is fixed to the end of one of the strands (7) of the bracelet. Locking means (11) maintain the drawer attached to the watch case once said drawer is introduced into the housing in the watch case.

13 Claims, 3 Drawing Sheets

HOUSING FOR AN ENERGY CELL IN A WRISTWATCH

This invention relates to a watch capable of being attached to a part of the body by at least one band, such watch comprising a watch case, means for displaying the time of day controlled by an electronic circuit, an energization cell and a lateral opening formed in the watch case, said opening giving access to a housing in which the cell is adapted to be placed.

BACKGROUND OF THE INVENTION

Such an arrangement has already been described in the patent document DE-U-1 803 093. In this document, there is found, located opposite the time setting crown, an opening giving access to a chamber adapted to contain an energization cell. Such chamber, located in the caseband of the watch, is either formed integrally with such caseband or subsequently assembled within the same caseband. A cover closes the opening to the chamber. Although such cover is provided with a shank enabling removal thereof, it will be understood that this operation is difficult of manipulation, taking into account above all the small dimensions of such cover. On the other hand, once the cover is open, there arises the problem of extraction of the cell, jammed as it is by a contact spur bearing thereon, this giving rise to the necessity of applying shocks to the watch in order to proceed with such extraction.

SUMMARY OF THE INVENTION

To avoid the difficulties mentioned hereinabove, the watch of the invention is characterized by the fact that the cell is borne by a drawer to which is fixed one of the ends of the band, locking means maintaining the drawer attached to the case when said drawer is introduced into said opening.

The invention will now be understood following reading of the description illustrated by way of example by the drawings.

DESCRIPTION OF THE PREFERRED EMBODIMENT

Figure 1:
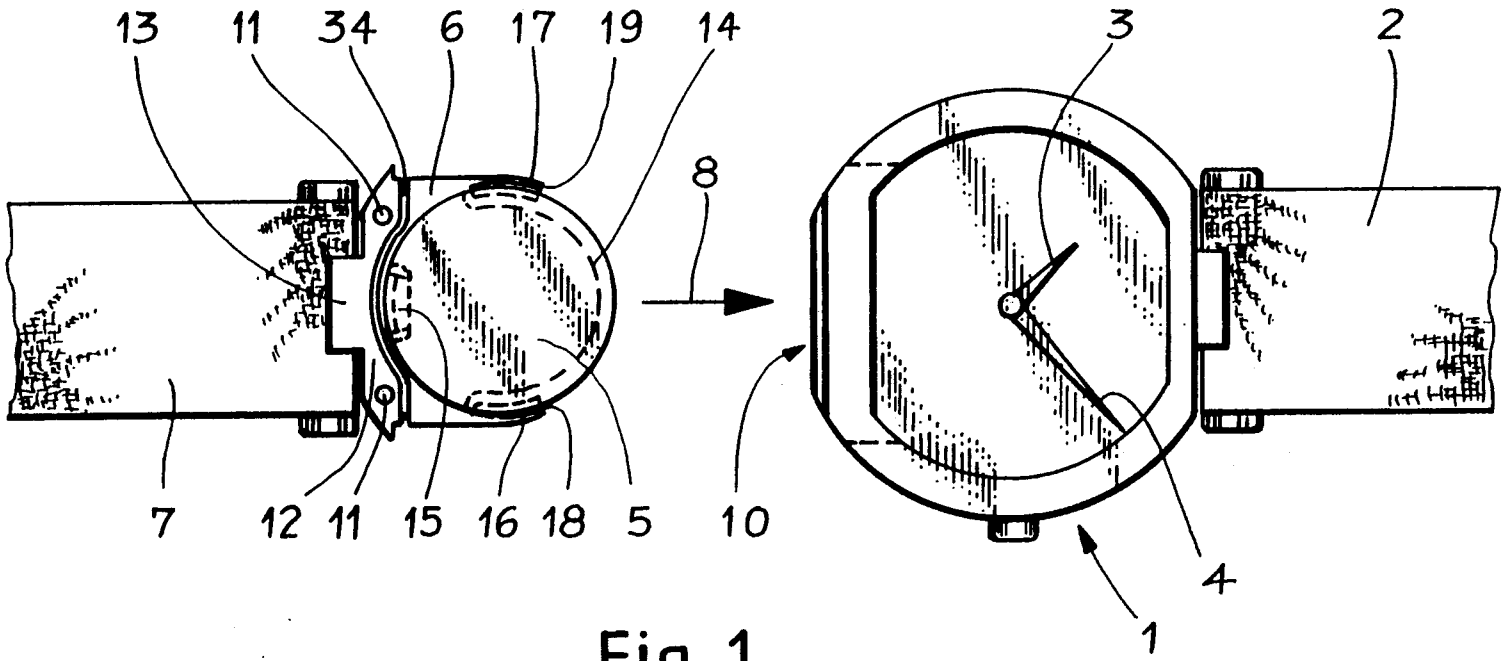
FIG. 1 is a top view of the watch according to the invention, with the drawer bearing the cell shown removed from its housing.

FIG. 1 is a top view of a wristwatch including, on one hand, a watch case 1 attached to a first strand 2 of the bracelet. Within such watch case are found display means represented here by the hours hand 3 and minutes hand 4. The wristwatch includes on the other hand an energization cell 5 housed in accordance with the invention in a drawer 6, such drawer being attached to a second strand 7 of the bracelet. The cell 5 and the drawer 6 which carries it may be introduced, according to the invention and in the sense of arrow 8, into a housing 9 (see FIG. 2) through an opening 10 formed in the watch case. Locking means, summarily symbolized on FIG. 1 by elements 11, maintain the drawer 6 attached to the watch case 1 when the drawer is introduced into the housing 9.

The invention is not limited to a wristwatch as shown on FIG. 1. It may be extended to any watch adapted to be attached to the body by at least one band, as would be the case, for instance, for a pendant watch. In this latter case, the strand 7 would be the only one to subsist, attached by one of its ends to the drawer 6 and by the other of its ends to the neck of the wearer.

The drawer may be a ring which entirely surrounds cell 5. However, in order to save space, the construction shown on FIG. 1 will be preferred. Here, the drawer is constituted by a portion 12 including a projection 13 to which is attached strand 7 of the bracelet in a hinged manner. Drawer 6 includes a bottom 14 and raised edges 15, 16 and 17 on which the cell 5 rests. Edges 16 and 17 show ends 18 and 19 arranged beyond the diameter of the cell in a manner to retain the latter in the drawer when one removes the drawer from its housing.

Figure 2:
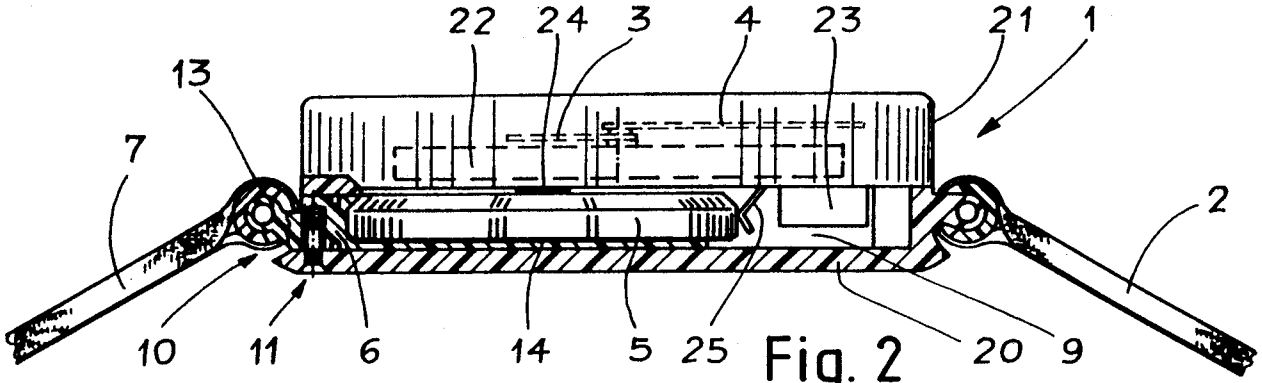
FIG. 2 is a cross-section of the bottom portion of the watch, the upper portion of the caseband not being shown in cross-section.

FIG. 2 is a cross-section of the bottom portion of the watch if one supposes the drawer 6 placed within its housing 9. The watch case is composed here by a back cover 20 and an upper portion or caseband 21. The drawer 6 and its adjoining bottom 14 may be introduced through an opening 10 formed in the back cover 20. The strand 7 of the bracelet is attached to the drawer by hinge 13. FIG. 2 further shows, in its upper portion 21, hands 3 and 4 for displaying hours and minutes. Such hands are driven by a mechanism 22 including gearing controlled by a stepping motor. The system is generally completed by an electronic circuit 23 including a time base, a frequency divider and a driver. The connections coupling such circuit to the cell 5 are indicated by references 24 and 25. The locking system 11 maintains the drawer in the watch case.

Figure 3:
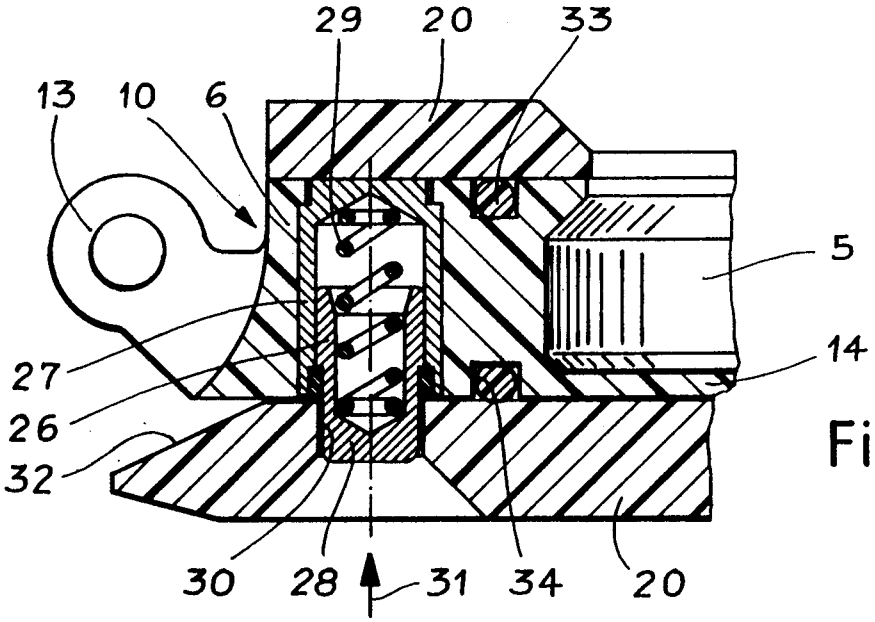
FIG. 3 is a detail taken from FIG. 2 of an example of locking of the drawer to an enlarged scale.

An example of locking for the drawer in the watch case is shown in detail on FIG. 3 which is an enlargement of region 11 shown on FIG. 2. The latch includes a push piece 26 sliding in a tube 27 anchored or force fitted in drawer 6. The push piece 26 comprises a head 28 which emerges from tube 27 under the urging of a spring 29. When the drawer is introduced in its housing, the head 28 of the push piece penetrates into a hole 30 formed in the back cover 20 and thus blocks the drawer inside the watch case. In order to remove the drawer, one exerts a force according to arrow 31 on head 28 while pulling simultaneously on strand 7, itself attached to the hinge 13 of the drawer. Inversely, following introduction of the drawer into the watch case, the push piece 26 retracts into the tube through the combined action of head 28 and a ramp 32 provided on the back cover 20, to the point where head 28 is located above hole 30 into which it penetrates.

Should one wish that the watch be sealed, there will be arranged a packing 33 between drawer 6 and the opening 10 formed in the back cover 20. Such packing is arranged in a channel 34 surrounding the drawer (see FIGS. 1 and 3).

Figure 4:
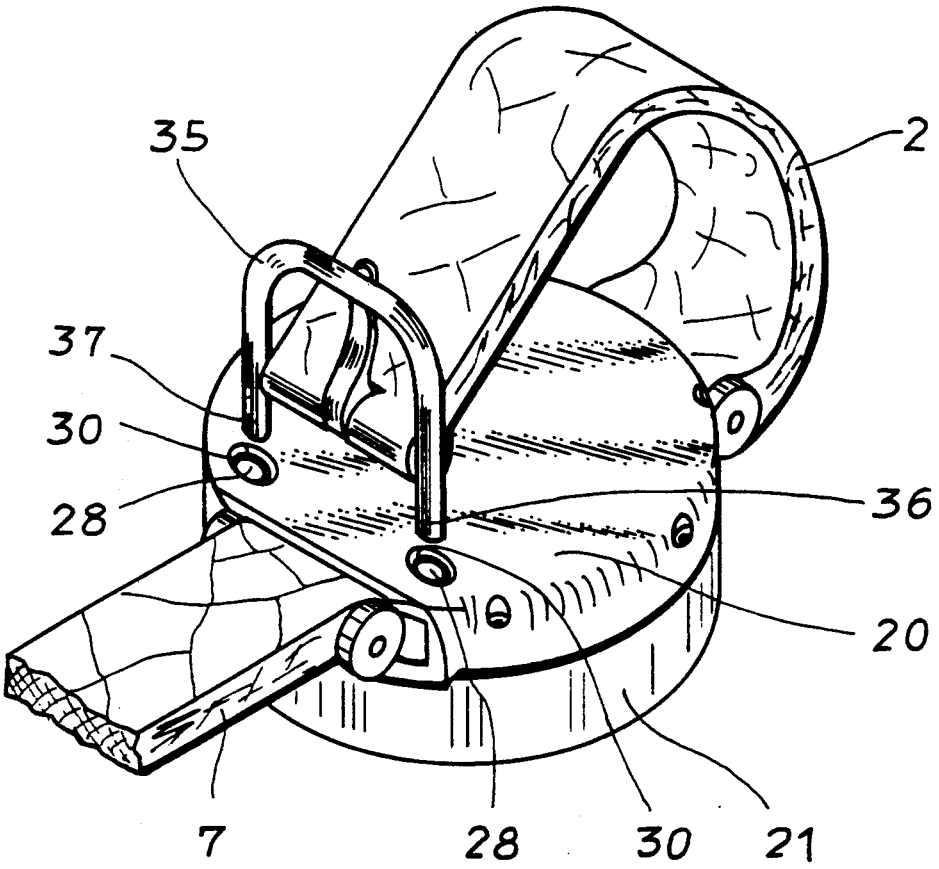
FIG. 4 is a perspective view of the watch, with an example of the arrangement for unlocking the drawer.

The locking of drawer 6 includes at least one push piece 26. Preferably, however, there will be arranged two push pieces in order to assure a stable closing without play. In order to exert pressure 31, as has been mentioned with reference to FIG. 3, one may employ any type of pointed object. An advantageous system may consist in making use of the buckle attached to the end of strand 2 of the bracelet, and this in the manner shown on FIG. 4. In such FIG. 4, the hinged buckle 35 serving as an ordinary clasp, bears two spurs 36 and 37 formed as prolongations of the branches of the buckle. If the distance between such spurs corresponds to the spread existing between the heads 28 of the locking system, one may employ the buckle as unlocking key by plunging such spurs into holes 30 in order to retract heads 28 into the drawer and thus liberate such drawer from the watch case.

The drawer system as proposed, from the fact that it may be extracted from the watch case simply by pulling on the bracelet strand to which it is attached greatly facilitates changing the cell by the watch wearer himself. This is particularly advantageous in the case where such cell must be frequently changed, for instance in the case of a cell feeding the radio frequency portion of a watch intended to receive radio broadcast messages.

A watch intended to receive radio broadcast messages is described in the patent document EP-A-0 339 482 (US-A-4,884,252). There has been indicated in such document that the receiving antenna is a winding surrounding the movement, the axis of such winding being arranged preferably parallel to the longitudinal direction of the bracelet. The novelty presented by this invention thus brings about a useful complement to the watch of the cited document since it enables arranging the cell within the winding whilst being able to extract such cell along the axis of the winding, such axis coinciding with the longitudinal direction of the bracelet.

What we claim is:

1. A watch having at least one strand for attaching said watch to a wearer, said watch comprising a watch case, display means for displaying the time of day, an electronic circuit for controlling said display means, an energization cell for energizing said electronic circuit, a drawer for carrying said energization cell, means for connecting said drawer to an end of said strand, a housing for receiving said drawer and said energization cell, a lateral opening in said watch case through which said energization cell and said drawer may be introduced into said housing, and locking means for securing said drawer to said watch case once said drawer is introduced into said housing.

2. A watch as claimed in claim 1 and further comprising a groove in said drawer and a moisture-tight packing housed in said groove, said packing cooperating with said watch case to assure an hermetic seal between said drawer and said watch case when said drawer is introduced into said housing.

3. A watch as claimed in claim 1 wherein said watch is a wristwatch and said one strand is part of a bracelet, said bracelet having a second strand attached to said watch case.

4. A watch as claimed in claim 3 wherein said locking means comprises a tube anchored in said drawer, a push piece slidable in said tube, and a spring urging a head of said push piece from said tube, said watch case having a hole into which said push piece penetrates when said drawer is introduced into said housing.

5. A watch as claimed in claim 3 wherein said locking means comprises two tubes anchored in said drawer, two push pieces slidable in said tubes, and two springs urging heads of said push pieces from said tubes, said watch case having holes into which respective ones of said push pieces penetrate when said drawer is introduced into said housing.

6. A watch as claimed in claim 5 and further comprising a buckle hinged to one of said strands, said buckle having two projections extending therefrom, each said hole being shaped and positioned for receiving a respective one of said projections, whereby said heads of said push pieces are forced into said drawer when said projections are inserted into said holes.

7. A watch as claimed in claim 2 wherein said watch is a wristwatch and said one strand is part of a bracelet, said bracelet having a second strand attached to said watch case.

8. A watch as claimed in claim 7 wherein said locking means comprises a tube anchored in said drawer, a push piece slidable in said tube, and a spring urging a head of said push piece from said tube, said watch case having a hole into which said push piece penetrates when said drawer is introduced into said housing.

9. A watch as claimed in claim 8 wherein said locking means comprises two tubes anchored in said drawer, two push pieces slidable in said tubes, and two springs urging heads of said push pieces from said tubes, said watch case having holes into which respective ones of said push pieces penetrate when said drawer is introduced into said housing.

10. A watch as claimed in claim 9 and further comprising a buckle hinged to one of said strands, said buckle having two projections extending therefrom, each said hole being shaped and positioned for receiving a respective one of said projections, whereby said heads of said push pieces are forced into said drawer when said projections are inserted into said holes.

11. A watch having at least one strand for attaching said watch to a wearer, said watch comprising a watch case, display means for displaying the time of day, an electronic circuit for controlling said display means, an energization cell for energizing said electronic circuit, a drawer for carrying said energization cell, means connecting said drawer to an end of said strand, a housing for receiving said drawer and said energization cell, a lateral opening in said watch case through which said energization cell and said drawer may be introduced into said housing, drawer locking means for preventing removal of said drawer from said housing in response to a tension force in said strand, and unlocking means cooperating with said drawer locking means to free said drawer and permit its removal from said housing when a tension force is applied to said strand.

12. A watch as claimed in claim 11 wherein said locking means comprises two holes in said watch case, slidable push pieces carried by said drawer in said holes, and springs urging said push pieces into said hole when said drawer is introduced into said housing.

13. A watch as claimed in claim 12 wherein said unlocking means comprise a buckle hinged to said strand, said buckle having two projections extending therefrom, each said hole being shaped and positioned for receiving a respective one of said projections, whereby said heads of said push pieces are forced into said drawer when said projections are inserted into said holes.

* * * * *